US007793775B2

(12) United States Patent
Rozenfeld et al.

(10) Patent No.: US 7,793,775 B2
(45) Date of Patent: Sep. 14, 2010

(54) METHOD AND APPARATUS FOR DETERMINING WEAR OF A CONTINUOUS CHAIN

(75) Inventors: Boris Rozenfeld, New Milford, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 102 days.

(21) Appl. No.: 12/144,924

(22) Filed: Jun. 24, 2008

(65) Prior Publication Data

US 2009/0317216 A1 Dec. 24, 2009

(51) Int. Cl.
*B65G 43/00* (2006.01)

(52) U.S. Cl. ..... 198/810.03; 198/502.1

(58) Field of Classification Search ..... 198/810.01, 198/810.03, 810.04, 502.1, 502.3; 270/52.16, 270/52.14, 52.26, 52.29, 58.02, 58.28
See application file for complete search history.

(56) References Cited

U.S. PATENT DOCUMENTS 4,657,131 A * 4/1987 Brychta et al. ..... 198/810.04
5,002,177 A * 3/1991 Winning ..... 198/810.04
5,143,206 A * 9/1992 Hoover ..... 198/810.04
5,363,967 A 11/1994 Tilles et al.
5,563,392 A 10/1996 Brown et al.
5,641,058 A * 6/1997 Merten et al. ..... 198/810.04
5,647,640 A * 7/1997 Heintzmann et al. ..... 299/1.6
6,029,799 A * 2/2000 Weigel et al. ..... 198/810.04
6,328,297 B1 12/2001 Antonelli et al.

* cited by examiner

*Primary Examiner*—Mark A Deuble
(74) *Attorney, Agent, or Firm*—Michael J. Cummings; Angelo N. Chaclas

(57) ABSTRACT

A system for detecting wear in a gripper chain of a chain conveyor is provided. The system includes an optical sensing system having a detection path located vertically beneath a portion of the gripper chain at a predetermined location. The detection path is located such that, when the gripper chain becomes elongated and droops a predetermined amount due to wear of the gripper chain, the sensing system senses the presence of the gripper chain in the detection path.

11 Claims, 3 Drawing Sheets

METHOD AND APPARATUS FOR DETERMINING WEAR OF A CONTINUOUS CHAIN

FIELD OF THE INVENTION

The invention relates to a continuous chain and, more particularly, to detecting wear in a continuous chain.

BACKGROUND OF THE INVENTION

Gripper chain conveyors are known in the paper handling industry. They provide reliable and deterministic paper handling by firmly clamping the material to be conveyed in a gripper attached to the chain, while the conveyor chain is in motion or is executing a motion profile. Some document inserter systems utilize a gripper chain that delivers envelopes from an envelope feeder/supply to an insertion station, and then onto a mailing output system for subsequent mail finishing. Motion of the gripper chain between the feeder, the insertion station and the output system is conducted in a stop/start incremental fashion.

A fundamental disadvantage to gripper chain conveyors is that, over time, the chain link pivots wear, resulting in chain stretch. As a chain stretches, there can be several undesirable effects for the apparatus described above. One example of an undesirable effect is that the at-rest insertion gripper position becomes unrepeatable with chain backlash. In another example, the slack side of the chain begins to oscillate aggressively resulting from the stop/start motion. The oscillation accelerates chain wear and possibly damages surrounding mechanisms.

Therefore, periodic chain tensioning is required to maintain reliable operation. For the apparatus described above, it is desirable to detect when there is sufficient chain stretch to warrant a re-tensioning operation to avoid these undesirable effects. Conventionally, re-tensioning and readjustment of the assembly is carried out once the insertion activity becomes unreliable or after the gripper chain causes damage to itself and/or surrounding mechanisms.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with one aspect of the invention, a system for detecting wear in a gripper chain of a chain conveyor is provided. The system includes an optical sensing system having a detection path located vertically beneath a portion of the gripper chain at a predetermined location. The detection path is located such that, when the gripper chain becomes elongated and droops a predetermined amount due to wear of the gripper chain, the sensing system senses the presence of the gripper chain in the detection path.

In accordance with another aspect of the invention, an apparatus is provided comprising a gripper chain, a transmission system, and a sensing system. The gripper chain comprising a continuous chain and grippers on the continuous chain. The transmission system is provided for supporting and rotating the gripper chain in a loop. The gripper chain comprises a vertically sagging generally arcuate, for example, hyperbolic, section on the transmission system. The sensing system comprises a first sensor for sensing a first one of the grippers at a first location, and a second sensor for sensing a second one of the grippers in the vertically sagging generally arcuate section of the gripper chain at a second location. The second sensor is configured to sense the presence of the second gripper at the second location when the vertically sagging generally arcuate section of the gripper chain droops a predetermined amount due to wear in the gripper chain.

In accordance with another aspect of the invention, a method is provided comprising sensing by a sensor whether a portion of a gripper chain is located in a predetermined area vertically beneath a normal path of the gripper chain, and sending a signal by the sensor when the portion of the gripper sags into the predetermined area due to wear of a continuous chain of the gripper chain.

In accordance with another aspect of the invention, a method is provided comprising determining when a vertically drooping portion of a gripper chain exceeds a predetermined amount of droop comprising sensing when the portion of the gripper chain droops into a predetermined location, and based upon a determination that the portion has exceeded the predetermined amount of droop, performing a predetermined task by a controller.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The foregoing aspects and other features of the invention are explained in the following description, taken in connection with the accompanying drawings, wherein.

DETAILED DESCRIPTION OF EXEMPLARY EMBODIMENTS

Figure 1:
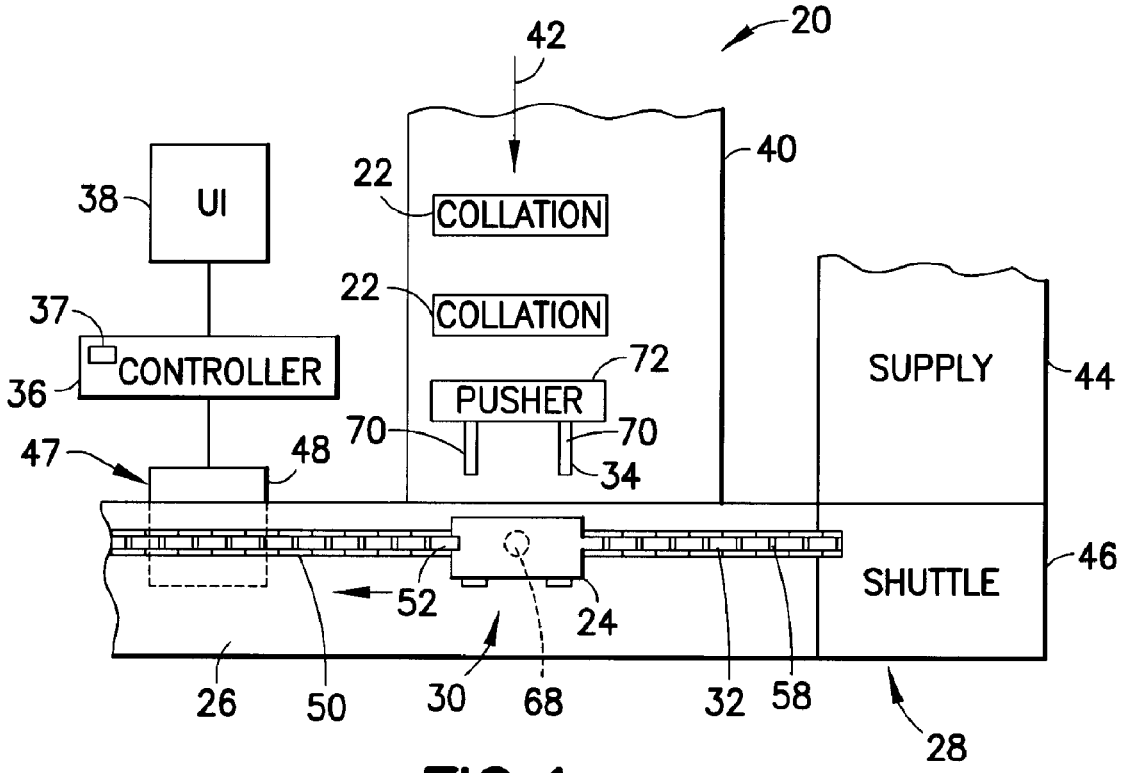
FIG. 1 is a top plan view of an apparatus comprising features of the invention.

Referring to FIG. 1, there is shown a top plan view of an apparatus 20 incorporating features of the invention. Although the invention will be described with reference to the exemplary embodiments shown in the drawings, it should be understood that the invention can be embodied in many alternate forms of embodiments. In addition, any suitable size, shape, or type of elements or materials could be used.

The apparatus 20 is a mail inserter adapted to insert an item, such as an insert, e.g., collation 22, of documents into a holder, such as an envelope 24. However, features of the invention could be used in any suitable type of inserter apparatus or apparatus having a continuous chain as further understood from the description below. The apparatus 20 comprises a deck 26, a mover 32, an opening system 34, and a controller 36. The controller 36 can include a computer, for example, having a processor and a memory 37.

Figure 3:
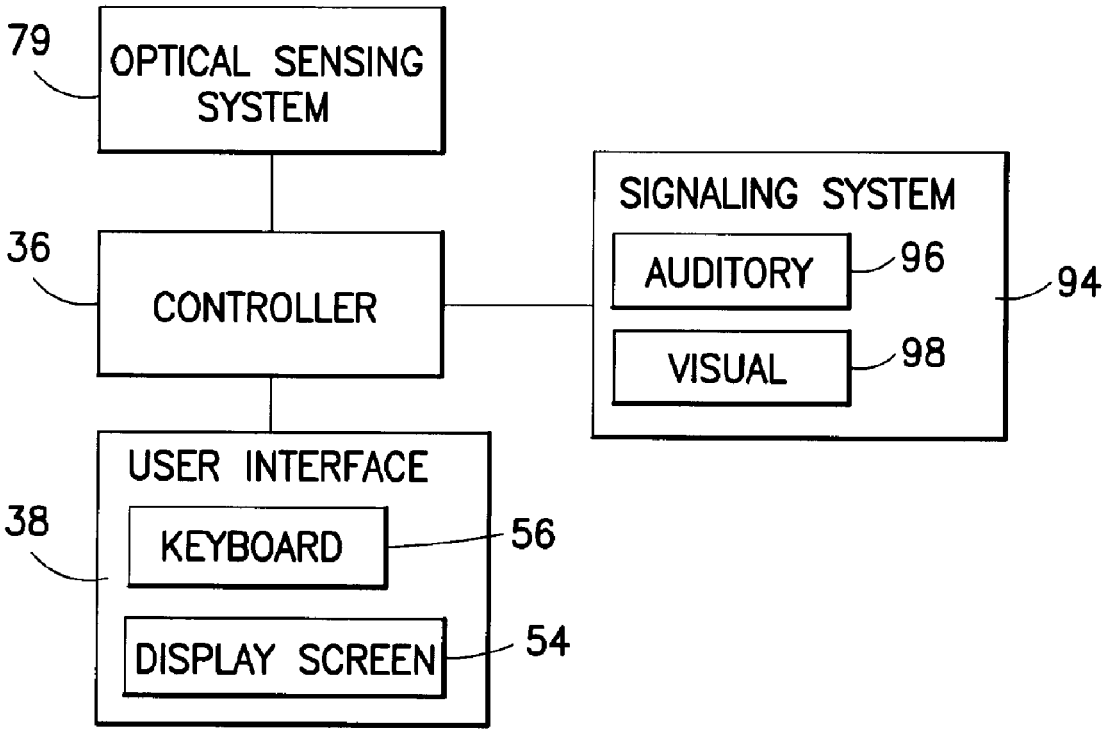
FIG. 3 is a block diagram of components of the apparatus shown in FIG. 1.

The apparatus 20 can also include a user interface 38. As seen in FIG. 3, the user interface 38 can include, for example, a display screen 54 and a keyboard 56 for a user to input information or select settings for the controller 36. However, any suitable user interface could be provided.

The apparatus 20 also includes a collation assembly section 40, which assembles the collations 22. The collation assembly section 40 comprises a movable deck for feeding the collations 22 towards the collation loading location 30, as indicated by arrow 42. The apparatus 20 also includes an envelope supply section 44. The envelope supply section 44 includes an envelope shuttle 46 for feeding individual envelopes from the supply section 44 to the mover 32. In alternative embodiments, any suitable type of item supply 40 and holder supply 44/46 could be provided.

Figure 2:
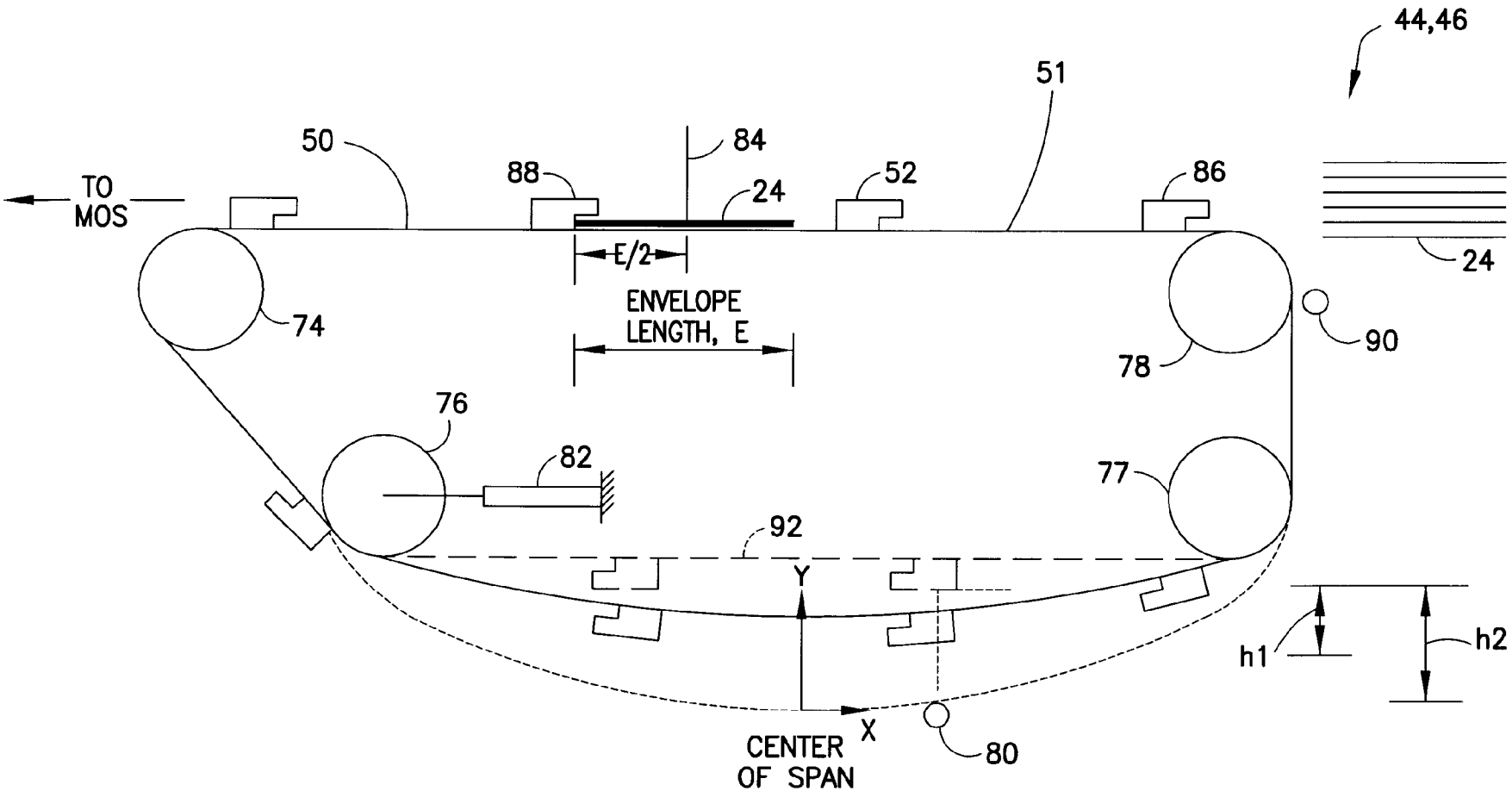
FIG. 2 is a schematic view of an embodiment of the system of the invention.

The deck 26 is adapted to slidably support an envelope 24 from a supply location 28 at the shuttle 46 to a collation loading location 30, and subsequently off of the deck 26 to the mailing output system (MOS). The mover 32 generally comprises a gripper chain 50 and a transmission system 47. The transmission system 47 is configured for supporting and rotating the gripper chain 50 in a loop. Referring also to FIG. 2, the transmission system 47 generally comprises a driven sprocket 74 connected to a drive motor 48 (see FIG. 1) by a start/stop transmission, and idler sprockets 76-78.

The gripper chain 50 generally comprises a continuous chain 51 and grippers 52. The continuous chain, i.e., endless chain 51 is provided as pivotably connected metal links in the form of a loop. In one embodiment, the grippers 52 comprise spring loaded jaws that are attached to the continuous chain 51. The gripper jaws are adapted to open and close to grip onto an end of one of the envelopes 24. Multiple grippers 52 are provided on the chain 51 at spaced locations for greater throughput of the envelopes 24 for each revolution of the gripper chain loop.

The driven sprocket 74 is connected to the gripper chain 50 to rotate the gripper chain 50. The gripper chain 50 is arranged to have a top portion located in a slot 58 of the deck 26, such that the top portion rotates through the slot 58 in an elongate path from the shuttle 46 to the opposite end of the deck 26. In one embodiment, the start/stop transmission between the driven sprocket 74 and the motor 48 includes an index box (not shown) adapted to stop and start movement of the driven sprocket 74 even though the motor 48 might still be rotating. In another embodiment, the motor 48 comprises a servo motor executing incremental motion. Other arrangements may also be used.

The transmission can also connect the motor 48 with a cam cluster to open the grippers 52 at predetermined locations and also to run the envelope shuttle 46. In alternative embodiments, this connection might not be provided, such as when the grippers and/or the envelope shuttle are powered by an alternative drive. Alternatively, any suitable connection between the cam cluster and the motor could be provided.

At the collation loading location 30 shown in FIG. 1, the mover 32 moves the envelope 24 to the location 30 from the supply location 28. The gripper chain 50 then stops, and the opening system 34 opens the envelope 24 for subsequent insertion of one of the collations 22. The opening system 34 includes a vacuum cup 68 for vacuum holding one side of the envelope, and fingers 70 that extend into the envelope 24 to enlarge the opening into the envelope. In one embodiment, the vacuum cup 68 comprises two physical cups. Other arrangements for holding the side of the envelope so the envelope can be opened may also be used.

The gripper 52 at the location 30 is opened to release the envelope during insertion of the collation 22 into the envelope 24. The pusher 72 inserts the collation 22 into the envelope 24. The gripper 52 is then allowed to re-grip the envelope and the opening system 34 can be disengaged. The mover 32 can then proceed to move the assembled envelope and inserted collation downstream along the deck 26.

The invention comprises a chain tension detection method and an system for detecting wear in a continuous chain. Chain tension, stretch elongation, and resulting chain droop anywhere along a uniform chain can be accurately mathematically described by a curve called the catenary. The method includes the use of a sensing system for sensing when droop, i.e., sag, of a portion of the gripper chain exceeds a predetermined amount of droop. This excessive droop is indicative of wear in the continuous chain, signaling that chain tensioning should be performed.

In one embodiment, the sensor system is an optical sensing system. In an alternative embodiment, the sensor system could be another type of non-optical sensing system, such as a mechanical or electromechanical system, for example. Although photocells are described below, any suitable type of optical sensing system could also be used.

In the embodiments illustrated in FIGS. 2 and 3, the optical sensing system 79 comprises a photocell 80 located at a predetermined distance directly below the at-rest position of a gripper located on the slack side of the chain. When the beam of the droop photocell 80 becomes blocked by a gripper while the chain is at rest and in its normal stopping position, the control system issues a warning message that instructs the operator that a re-tensioning and table adjustment procedure is due soon or immediately for continued reliable operation.

In a further embodiment, the entire process may be automated. Embodiments of the invention may increase the reliability of chain-driven equipment, such as inserters, and may decrease both down time and service costs.

In the embodiment shown in the drawings, the endless gripper chain 50 comprises eight grippers 52 that are located 13.5 inches apart on the chain 51. Other numbers and arrangements of grippers may also be used. In FIG. 2 the grippers 52 are shown in their normal at-rest stopping locations. The gripper chain 50 is driven by the driven sprocket 74 that is driven by the motor 48. The gripper chain 50 is initially tensioned and periodically re-tensioned thereafter by tension mechanism 82.

In one embodiment, the tensioning mechanism 82 comprises a pneumatic cylinder that provides a known force to a slidable idler sprocket assembly 76. In alternative embodiments, any suitable tensioning mechanism could be provided. During tensioning, the idler sprocket 76 is unlocked from a fixed location, compressed air is applied to the pneumatic cylinder, and the idler sprocket is then relocked in its new fixed position. Any device providing substantially constant force over the adjustment range may be substituted for the pneumatic cylinder.

After re-tensioning, left to right adjustment of the entire gripper assembly is currently done with an electric motor/lead screw mechanism (not shown) that uses human feedback and control to properly locate the table with the centerline 84 of insert feed from the collation assembly station 40.

During operation, envelopes 24 are delivered from the envelope supply 44 by the shuttle mechanism 46 to a gripper that is located at the feeder gripper position 86, where a single envelope is clamped firmly at its lead edge by that gripper. Gripper chain 50 increments one gripper pitch displacement (13.5 inches) by the motor and the start/stop transmission executes an incremental motion profile that comes to rest in less than one machine cycle period.

Two gripper pitches downstream of the feeder gripper position 88 is the insertion gripper position 88. The optimum at-rest position of this gripper is displacement E/2 downstream of the insertion engine/chassis centerline, where E is the length of an envelope 24. To accommodate different length envelopes (different E dimensions), the entire insertion table, i.e., front table, assembly is adjusted left to right such that the E/2 dimension from a fixed insertion engine centerline 84 to insert gripper position 88 is achieved.

The at-rest gripper chain position is initially defined at machine startup by a motion profile that moves a gripper some pre-determined displacement past a homing photocell 90 that detects the lead edge (blocked condition) of that gripper. The predetermined displacement is chosen such that that gripper comes to rest at the feeder gripper position 86.

In one example, the homing photocell 90 is in close proximity to the feeder gripper position 86, so that precise and repeatable positioning of this gripper is maintained to ensure reliable envelope delivery from the 46 shuttle mechanism that delivers a single envelope from an envelope supply 44 to this gripper. Since this predetermined displacement is small, as the chain stretches, the effect on the location of the feeder gripper position 86 is negligible. However, as the chain 51 stretches, the same cannot be said of the location of insertion gripper 88, which is located some distance greater than two gripper pitches from the homing photocell 90. For this position 88, as the chain stretches, the location of the at-rest position will move downstream from its initial position and excess chain will be stored in the form of chain droop below bottom idler sprockets 76 and 77.

Downstream drift of insertion gripper position 88 may result in making the insertion and post-insertion activities unreliable. During operation, an empty envelope is delivered by a gripper to the insertion gripper position 88 in the insertion area. Once at rest, this gripper opens so that the envelope can be prepared by a mechanism to be in an open position to allow collation contents to be inserted. If the gripper position 88 is downstream from where is should be, the collation will not be centered with the prepared envelope and may not successfully enter the envelope at area 30. This is aggravated by thick collations and/or collation widths that approach the envelope length dimension, E. Furthermore, if the collation does enter the envelope, the ungripped envelope may shift upstream by the action of the collation entering and when insertion is complete, the envelope may be too far upstream to be re-gripped by the gripper successfully for subsequent downstream conveyance by the gripper chain.

The downstream shift of the insertion gripper position may be avoided by periodically re-tensioning the chain and readjusting the entire insertion table assembly so that the E/2 dimension is restored. It should be noted that the shuttle mechanism 46 travels with the front table, while the envelope supply does not. The displacement relationship of the envelope supply with respect to the shuttle mechanism is not critical for reliable operation, unlike the displacement relationship of the gripper mechanism to feeder gripper position 88, which needs to remain substantially constant.

In one example, life testing of the front table gripper chain assembly demonstrated initial chain stretch of roughly 0.030 inches per 13.5 inches (gripper pitch) at 3.3 million insertion cycles when the chain was correctly tensioned at the beginning of the test. At the insertion gripper position 88, which is slightly over two pusher pitches away from the chain homing photocell 90, this stretch would be roughly 0.060 inches. This dimension is coincidentally estimated to be about the limit before the insertion table needs to be adjusted for reliable insertion and insertion gripper operation. It has been determined that the rate of chain stretch will significantly decrease after initial break-in or the first re-tension. This is likely due to the chain pin bearing areas effectively becoming larger after break-in.

The curve described by a uniform, flexible chain hanging under the influence of gravity is called the catenary. As shown in FIG. 2, the chain horizontal datum 92 is the elevation of the chain if the chain was infinitely tight (or massless) and did not droop at all. Each time the gripper chain 50 is properly tensioned by the chain tensioning mechanism 82, the gripper chain 50 will droop at some initial distance, h1. During machine operation, the chain 51 stretches due to wear and the gripper chain 50 will eventually droop to a new distance, h2. This distance is the computed location of the droop photocell 80 and is based on the maximum desired 0.030 inches of stretch per gripper pitch.

End of life for the chain due to excessive stretch will occur when the tensioning mechanism 82 reaches its design limit of its travel, such as after roughly one inch of total chain stretch, for example. This equates to four re-tensioning operations after initial installation (0.030 inches×8 pitches×4 times=0.96 Inches), assuming re-tensioning is conscientiously performed each time the control system issues the warning message. This total amount of chain stretch is consistent with end of service life recommendations published by the chain manufacturer. The control system may incorporate additional logic that will not allow machine operation past a configurable number of machine cycles after the warning message is issued to the operator.

Referring also to FIG. 3, in the illustrated embodiment the apparatus 20 comprises a signaling system 94 connected to the controller 36. The signaling system 94 can include an auditory signaling device 96, such as a horn or buzzer, for example, and/or a visual signaling device 98, such as a flashing light, for example. The optical sensing system 79 (which includes the two photocells 80, 90) is connected to the controller 36 to send signals to the controller corresponding to sensed locations of the grippers 52. In the event the homing sensor 90 detects that the lead edge of a gripper is too late or too early relative to its intended timing, the controller 36 can cause the signaling system 94 to generate a signal to the operator that there is a potential problem.

Likewise, in the event the droop sensor 80 senses a presence of a gripper, the sensing system 79 sends a signal to the controller 36. The controller 36 then causes the signaling system 94 to generate a signal to the operator that there is a potential problem. In an alternative embodiment, the signaling system might merely comprise a display or warning generated on the display screen 54. Thus, a signaling system separate from the user interface 38 might not be provided.

Figure 4:
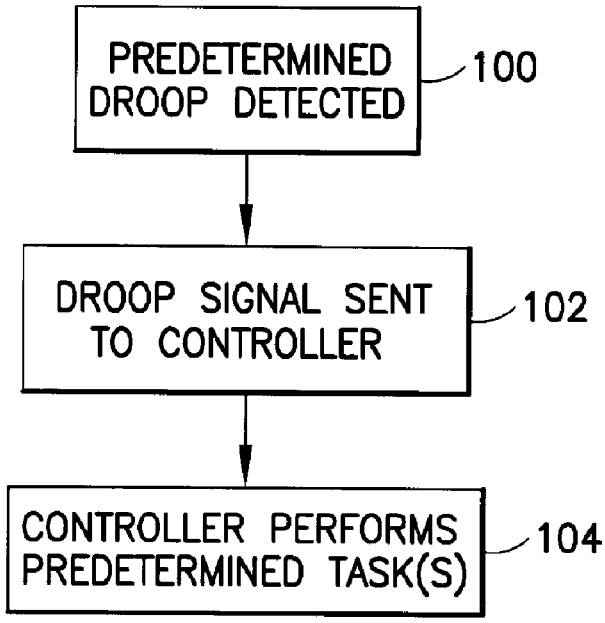
FIG. 4 is a flow diagram of some of the steps used with the apparatus shown in FIGS. 1-3 according to embodiments of the invention.

Referring also to FIG. 4, one method of the invention comprises a sensor, such as the photocell 80, detecting a predetermined droop as indicated by block 100. The sensor then sends a droop signal to the controller and, in some embodiments, separately to the signaling system 94, as indicated by block 102. The controller 36 can be configured or programmed with suitable software to perform one or more predetermined tasks based upon receipt of the signal, as indicated by block 104. The tasks could include, for example, generating a warning signal to the user (via the signaling system 94 or user interface 38, for example), and/or stopping the motor 48 to thereby stop the gripper chain 50, and/or performing an automatic chain tensioning as further described below. Any other suitable tasks could be provided.

In order to determine the proper location of the droop photocell 80, various factors can be used. The intrinsic equation of the shape of the catenary is given by the hyperbolic cosine function:

$$y=f(x)=T/w(\cosh(wx/T)-1)) \quad \text{Eq.(1)}$$

where:

T=horizontal component of chain tension w=weight per unit length of chain and x and y are the coordinate system located at the center and lowest part of the span as shown in FIG. 1.

The horizontal component of chain tension, T, closely approximates the tension anywhere in the chain if the sag is not excessive. For the insertion table, the initial tension of the chain is the value recommended by the chain manufacturer and:

T=25 lbf w=0.0342 lbf/inch

L=chain span length=43.2 inches (located between idler sprockets 76 and 77)

The droop photocell is located a horizontal distance x=7 inches from the center of the span. At the span endpoints, x=L/2=21.6 inches. Using Eq. (1) and solving:

f(0)=0.0000 inches f(7)=0.0335 inches f(21.6)=0.3192 inches

When the chain is initially tensioned by the tensioning mechanism 82, the initial chain droop at the droop photocell is distance hi from the horizontal datum as shown in FIG. 1. Therefore:

h1=f(21.6)−f(7)=0.286 inches

As the chain stretches, the initial chain tension reduces and the chain sag increases. The predetermined amount of chain stretch desired before a re-tensioning operation is performed is 0.030 inches per gripper pitch. This corresponds to a total chain length increase of (8 pushers)*(0.030 inches) or 0.240 inches. The increased length of the chain located within the span of the chain will increase by roughly this amount. The initial length of the chain in the span region is defined by:

$$S=(2T/w)\sinh(wL/2T) \quad \text{Eq.(2)}$$

where:

S=total length of chain in the span

Using Eq.(2), the initial chain length in the span, immediately after tensioning, is:

S1=43.206 inches

After the chain stretches to the predetermined amount, the new chain length in the span will be:

S2=S1+0.240 inches=43.446 inches

Solving for T from Eq. (2) and substituting the new value for chain length in the span, S2, the new chain tension is:

T2=4.00 lbf

Substituting the new tension value, T2, into Eq. (1):

f(7)=0.2095 inches f(21.6)=2.0002 inches

And the distance that the droop photocell is located is:

h2=f(21.6)−f(7)=1.791 inches below the horizontal datum

It should be noted that the dimensions noted above are merely examples and should not be considered as limiting the scope of the invention.

Figure 5:
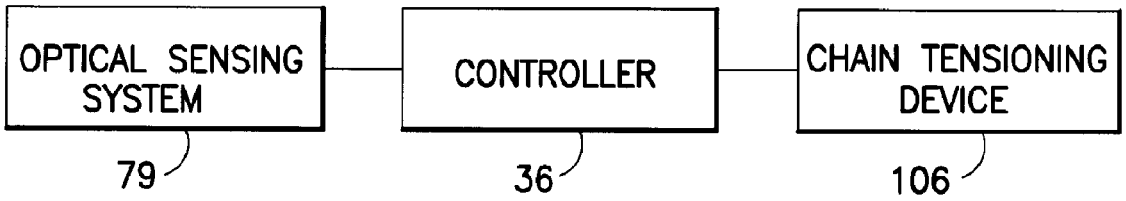
FIG. 5 is a block diagram of portions of an alternative embodiment of the apparatus shown in FIGS. 1-3.

In an alternative embodiment, the entire two-step process of re-tensioning the chain and readjusting the position of the front table assembly can be entirely automated under machine control. This is shown by example in FIG. 5. The apparatus can be provided with an automated chain tensioning device 106. The chain tensioning device 106 is connected to the controller 36. When the optical sensing system 79 signals the controller 36 that the predetermined amount of droop as been detected in the gripper chain 50, the controller 36 can then actuate the chain tensioning device.

In one embodiment, the reconfiguration of a convention system for use with an automated chain tensioning system comprises adding a machine-controlled brake to the air cylinder that currently tensions the chain, and disabling or removing the conventional manual locking mechanism, adding a feedback device to the electric motor that currently adjusts the table using human control, and adding control software to carry out the chain tensioning and table adjustment activities.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An apparatus comprising:

a mailpiece inserter configured to transport envelopes to an insertion area, receive mailpiece inserts into the envelopes at the insertion area, and transport the envelopes with inserts to another area;

a gripper chain for transporting the envelopes, the gripper chain comprising a continuous chain and grippers on the continuous chain for receiving the envelopes;

a transmission system for supporting and rotating the gripper chain in a loop, wherein the gripper chain comprises a vertically sagging generally arcuate section on the transmission system, and wherein the transmission system comprises a chain tensioning device;

a sensing system comprising:

a first sensor for sensing a first one of the grippers at a first location; and a second sensor for sensing a second one of the grippers in the vertically sagging generally arcuate section of the gripper chain at a second location, wherein the second sensor is configured to sense presence of the second gripper at the second location when the vertically sagging generally arcuate section of the gripper chain droops a predetermined amount due to wear in the gripper chain and to send a signal responsive to sensing the presence of the second gripper; and a controller configured to receive the signal from the second gripper and, responsive to the signal, to control the chain tensioning device to reduce the amount of droop of the gripper chain and to adjust a position of the gripper chain and the transmission system with respect to the insertion area.

2. The apparatus of claim 1, wherein the second sensor comprises an optical sensor.

3. The apparatus of claim 1, wherein the predetermined amount of droop is about twice a normal amount of droop of the gripper chain at the vertically sagging generally arcuate section.

4. The apparatus of claim 1, wherein the second sensor is configured to sense the second gripper at the second location while the gripper chain is substantially stationary.

5. The apparatus of claim 1, further comprising a signaling system connected to the sensing system, wherein the signaling system is configured to signal a user of the apparatus when the predetermined amount of droop has occurred.

6. The apparatus of claim 1, wherein the controller is further configured to stop operation of the transmission system responsive to the signal.

7. The apparatus of claim 6, wherein the controller is configured to stop operation of the transmission system after a predetermined amount of continued rotations of the gripper chain after the predetermined amount of droop occurs.

8. The apparatus of claim 7, further comprising a signaling system connected to the controller, wherein the signaling system is configured to signal a user of the apparatus when the predetermined amount of droop has occurred.

9. A method comprising:

transporting envelopes to an insertion area of a mailpiece inserter using a gripper chain, wherein the gripper chain comprises a continuous chain and grippers on the continuous chain for receiving the envelopes;

receiving mailpiece inserts into the envelopes at the insertion area;

transporting the envelopes with inserts to another area;

rotatably supporting the gripper chain in a loop on a transmission system, wherein the gripper chain comprises a vertically sagging generally arcuate section on the transmission system, and wherein the transmission system comprises a chain tensioning device;

sensing a first one of the grippers at a first location using a first sensor;

sensing a second one of the grippers in the vertically sagging generally arcuate section of the gripper chain at a second location using a second sensor, wherein the second sensor is configured to sense presence of the second gripper at the second location when the vertically sagging generally arcuate section of the gripper chain droops a predetermined amount due to wear in the gripper chain and to send a signal responsive to sensing the presence of the second gripper; and receiving the signal from the second gripper using a controller; and responsive to the signal, controlling the chain tensioning device to reduce the amount of droop of the gripper chain and to adjust a position of the gripper chain and the transmission system with respect to the insertion area.

10. The method of claim 9, further comprising signaling a user in response to the second sensor sensing the presence of the second gripper at the second location.

11. The method of claim 9, further comprising stopping the transmission system responsive to the signal.

* * * * *